US008288067B2

(12) United States Patent
Gong et al.

(10) Patent No.: US 8,288,067 B2
(45) Date of Patent: Oct. 16, 2012

(54) TONER PROCESSES

(75) Inventors: Yi Xin Gong, Mississauga (CA); Shigang Qiu, Toronto (CA); Daryl W. Vanbesien, Burlington (CA); Gabriel Iftime, Mississauga (CA); Edward Graham Zwartz, Mississauga (CA); Karen Ann Moffat, Brantford (CA); Richard P. N. Veregin, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 533 days.

(21) Appl. No.: 12/411,654

(22) Filed: Mar. 26, 2009

(65) Prior Publication Data

US 2010/0248118 A1 Sep. 30, 2010

(51) Int. Cl.
*G03G 9/09* (2006.01)

(52) U.S. Cl. ..... 430/108.6; 430/108.1; 430/109.4

(58) Field of Classification Search ..... 430/108.1, 430/108.6, 109.4
See application file for complete search history.

(56) References Cited

U.S. PATENT DOCUMENTS

| | | | | |
|---|---|---|---|---|
| 3,590,000 | A | 6/1971 | Palermiti et al. | |
| 3,800,588 | A | 4/1974 | Larson et al. | |
| 3,847,604 | A | 11/1974 | Hagenbach et al. | |
| 4,295,990 | A | 10/1981 | Verbeek et al. | |
| 4,298,672 | A | 11/1981 | Lu | |
| 4,338,390 | A | 7/1982 | Lu | |
| 4,935,326 | A | 6/1990 | Creatura et al. | |
| 4,937,166 | A | 6/1990 | Creatura et al. | |
| 5,236,629 | A | 8/1993 | Mahabadi et al. | |
| 5,290,654 | A | 3/1994 | Sacripante et al. | |
| 5,302,486 | A | 4/1994 | Patel et al. | |
| 5,330,874 | A | 7/1994 | Mahabadi et al. | |
| 5,554,480 | A | 9/1996 | Patel et al. | |
| 6,063,827 | A | 5/2000 | Sacripante et al. | |
| 6,214,507 | B1 | 4/2001 | Sokol et al. | |
| 6,593,049 | B1 | 7/2003 | Veregin et al. | |
| 6,664,017 | B1 * | 12/2003 | Patel et al. | 430/123.57 |
| 6,756,176 | B2 | 6/2004 | Stegamat et al. | |
| 6,830,860 | B2 | 12/2004 | Sacripante et al. | |
| 7,052,730 | B2 | 5/2006 | Patel et al. | |
| 7,785,761 | B2 * | 8/2010 | Hayashi et al. | 430/109.4 |
| 2004/0086694 | A1 * | 5/2004 | Ide | 428/195.1 |
| 2004/0105995 | A1 * | 6/2004 | Yuasa | 428/515 |
| 2005/0100807 | A1 * | 5/2005 | Yamazaki et al. | 430/108.6 |
| 2005/0214485 | A1 * | 9/2005 | Ide et al. | 428/32.38 |
| 2005/0214669 | A1 * | 9/2005 | Hayashi et al. | 430/109.4 |
| 2005/0233097 | A1 * | 10/2005 | Tojo et al. | 428/32.26 |
| 2006/0051686 | A1 * | 3/2006 | Ide et al. | 430/18 |
| 2006/0084000 | A1 * | 4/2006 | Tsunemi et al. | 430/108.4 |
| 2006/0160008 | A1 * | 7/2006 | Lee et al. | 430/108.6 |
| 2006/0204881 | A1 * | 9/2006 | Ota | 430/110.2 |
| 2006/0222991 | A1 | 10/2006 | Sacripante et al. | |
| 2007/0134578 | A1 * | 6/2007 | Choi et al. | 430/108.2 |
| 2007/0134580 | A1 * | 6/2007 | Yaguchi et al. | 430/108.7 |
| 2008/0145777 | A1 | 6/2008 | Iftime et al. | |
| 2008/0182200 | A1 * | 7/2008 | Kim | 430/270.14 |
| 2008/0187854 | A1 * | 8/2008 | Yoshida et al. | 430/109.4 |

(Continued)

*Primary Examiner* — Hoa V Le
(74) *Attorney, Agent, or Firm* — Judith L. Byorick

(57) ABSTRACT

The present disclosure provides toners and processes for making said toners. In embodiments, the toners are invisible when viewed under natural light, but possess a UV additive that renders them visible when exposed to UV light of a specific wavelength. By selecting the appropriate UV additive and ionic crosslinker, with optional chelating agent, the gloss of the toner may be tailored to match the gloss of any substrate, such as paper, to which the toner is to be applied, thereby further enhancing its invisibility under visible light.

18 Claims, 1 Drawing Sheet

U.S. PATENT DOCUMENTS

2008/0220187 A1 9/2008 Iftime et al.
2008/0236446 A1* 10/2008 Zhou et al. ..... 106/31.25
2010/0098887 A1* 4/2010 Matsuishi et al. ..... 428/32.1
2011/0117485 A1* 5/2011 Hermann et al. ..... 430/108.6

* cited by examiner

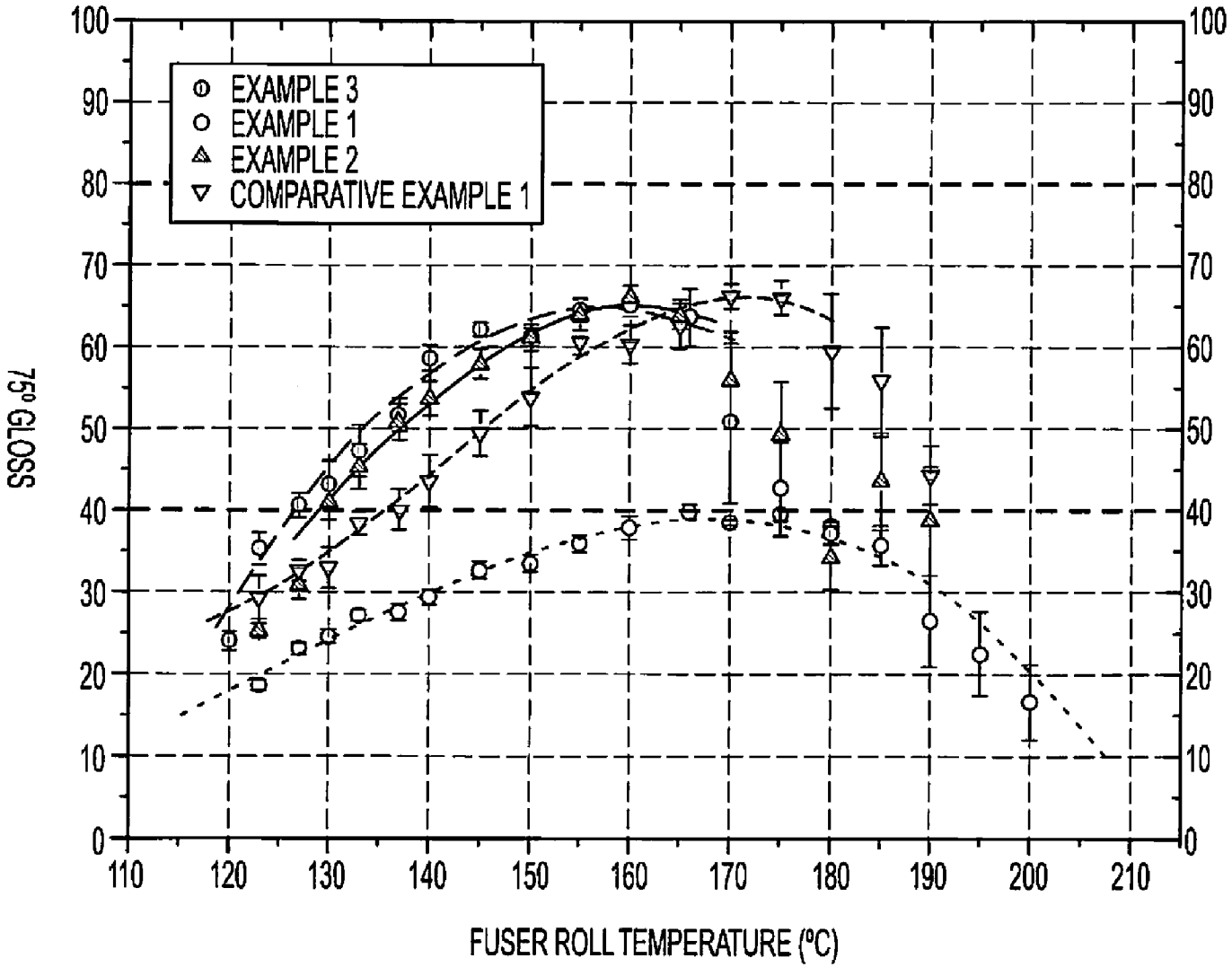
EXAMPLE 3
EXAMPLE 1
EXAMPLE 2
COMPARATIVE EXAMPLE 1
75° GLOSS
FUSER ROLL TEMPERATURE (°C)
0
10
20
30
40
50
60
70
80
90
100
110
120
130
140
150
160
170
180
190
200
210

TONER PROCESSES

BACKGROUND

The present disclosure relates to toners suitable for electrostatographic apparatuses and processes for making such toners.

Toner blends containing crystalline or semi-crystalline polyester resins with an amorphous resin have been recently shown to provide very desirable ultra low melt fusing, which is important for both high-speed printing and lower fuser power consumption. These types of toners containing crystalline polyester have been demonstrated for both emulsion aggregation (EA) toners, and in conventional jetted toners.

Fluorescent inks and dyes may be used as an authenticating feature in the document security industry. Secure documents, for example documents that are difficult to forge, may be conventionally created using inks that include fluorescent agents either alone or in combination with ordinary inks and/or pigments. Features printed using fluorescent inks are usually invisible under visible light, due to the colorless nature of the security inks or due to masking by other colorants in the document. Under proper illumination, however, the fluorescent features of the document are revealed in the form of a bright emission by the fluorescent dyes in the visible spectrum. For example, certain bank notes utilize visible features, such as holographic patches, microprinting and microtextures to conceal additional fluorescent threads and/or multi-colored emblems embedded in the bank note, which are only reveled under specific light frequencies. These features provide an increased level of security against counterfeiters by making the copying process of such a document more difficult.

Although fluorescent inks are available as described above, the use of toners for printing security features is somewhat limited. For example, U.S. Pat. No. 5,554,480, the disclosure of which is hereby incorporated by reference in its entirety, describes the use of ordinary organic fluorescent dyes which are applied via non-electrophotographic methods (flexo printing, inkjet, and the like). Furthermore, available fluorescent toners may appear colored under visible light, which defeats their usefulness as hidden security features.

Improved methods for producing toners which are suitable for use in creating security documents remain desirable.

SUMMARY

The present disclosure provides toners and processes for making said toners. In embodiments, the toners are invisible when viewed under natural light, but possess a UV additive that renders them visible when exposed to UV light of a specific wavelength. By selecting the appropriate UV additive, the gloss of the toner may be tailored to match the gloss of any substrate, such as paper, to which the toner is to be applied, thereby further enhancing its invisibility under visible light.

In embodiments, a toner of the present disclosure may include at least one amorphous polyester resin, at least one crystalline polyester resin, at least one additive capable of becoming visible upon exposure to ultraviolet light at a wavelength of from about 200 nm to about 400 nm when placed on a substrate containing fluorescent materials and, optionally, one or more ingredients such as waxes, coagulants, chelating agents, and combinations thereof, wherein the gloss of the toner substantially matches the gloss of the substrate to which it is applied.

Processes for producing such toners are also provided. In embodiments, a process of the present disclosure may include contacting at least one amorphous polyester resin and at least one crystalline polyester resin in an emulsion, contacting the emulsion with at least one additive capable of becoming visible upon exposure to ultraviolet light at a wavelength of from about 200 nm to about 400 nm when printed on a substrate possessing optical brighteners, contacting the emulsion with an optional wax, an optional chelating agent, and an optional coagulant to form a mixture, aggregating small particles in the mixture to form a plurality of larger aggregates, coalescing the larger aggregates to form toner particles, and recovering the particles.

In other embodiments, a process of the present disclosure may include determining a gloss of a substrate, contacting at least one amorphous polyester resin, and at least one crystalline polyester resin in an emulsion, contacting the emulsion with at least one additive capable of becoming visible upon exposure to ultraviolet light at a wavelength of from about 200 nm to about 400 nm, contacting the emulsion with at least one ionic crosslinker, contacting the emulsion with an optional chelating agent, contacting the emulsion with an optional wax, and an optional coagulant to form a mixture, aggregating small particles in the mixture to form a plurality of larger aggregates, coalescing the larger aggregates to form toner particles, and recovering the toner particles, wherein the toner particles possess a gloss that equals the gloss of the substrate.

DESCRIPTION OF THE DRAWINGS

Various embodiments of the present disclosure will be described herein below with reference to the FIGURE wherein:

The FIGURE is a graph comparing gloss characteristics versus fusing temperatures for several toners prepared in accordance with the present disclosure.

DETAILED DESCRIPTION

The present disclosure provides ultra low melt EA toner compositions and processes for making these toners. In embodiments, images from the toners of the present disclosure are invisible under normal viewing light conditions, but are detectable under ultraviolet (UV) light, for example when printed on a bright substrate containing optical brighteners. In embodiments, the mechanism for detection of the images is the absorption of exciting UV light by the otherwise essentially invisible toner.

In some embodiments, a toner of the present disclosure may be useful with a substrate possessing fluorescent materials thereon or therein. For example, a substrate containing embedded fluorescent materials may emit bright light when exposed to exciting UV light. Suitable fluorescent materials include optical brighteners which are fluorescent materials that may be embedded in substrates (for example, paper, plastics or cardboard) to prevent them from yellowing. While optical brighteners may emit blue or green light when excited with UV light, the fluorescent materials are not limited to optical brighteners emitting blue or green light only.

For example, it may be possible that the substrate is specially treated to contain a fluorescent material which is colored or colorless under normal light but which emits yellow or red light for example under UV light. A contrast may be provided when exposed to UV light between bright areas of the substrate and the darker areas where UV absorbing toner is printed. This mechanism for creating security is different from fluorescent toners. While both methods create a contrast between fluorescent and non-fluorescent areas, the mechanisms are different. With fluorescent toner, the toner emits light while the substrate has typically low or no fluorescence at all.

To the contrast, in accordance with the present disclosure, the toner is non-fluorescent and the substrate is fluorescent.

In embodiments, substrates suitable for the present disclosure include bright papers containing optical brighteners, coated or uncoated, porous and non-porous. Other substrates include plastics or cardboards as long as sufficient amounts of fluorescent materials are embedded within the substrate so that a contrast is created. In embodiments, white substrates may provide excellent contrast. However, any colored substrate is suitable as long as it contains sufficient optical brightener materials to produce detectable contrast between fluorescent and UV light absorbing areas. For example, the substrate could be yellow, green or other suitable color.

Toners of the present disclosure may have many uses including, in embodiments, security printing. Toners of the present disclosure may be clear, and may be designed to match the gloss of the substrate medium, e.g., paper, to which they are applied. The toners of the present disclosure are thus invisible to the naked eye under normal lighting conditions, but possess organic and/or inorganic fillers which absorb UV light, producing a dark image compared to plain paper upon exposure to UV light.

Resins

Toners of the present disclosure may include any latex resin suitable for use in forming a toner. Such resins, in turn, may be made of any suitable monomer. Suitable monomers useful in forming the resin include, but are not limited to, acrylonitriles, diols, diacids, diamines, diesters, diisocyanates, combinations thereof, and the like. Any monomer employed may be selected depending upon the particular polymer to be utilized, In embodiments, the polymer utilized to form the resin may be a polyester resin. Suitable polyester resins include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid or diester in the presence of an optional catalyst. For forming a crystalline polyester, suitable organic diols include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin, although the amounts can be outside of these ranges.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent, although the amounts can be outside of these ranges.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof. The crystalline resin may be present, for example, in an amount of from about 5 to about 50 percent by weight of the toner components, in embodiments from about 10 to about 35 percent by weight of the toner components, although the amounts can be outside of these ranges. The crystalline resin can possess various melting points of, for example, from about 30° C. to about 120° C., in embodiments from about 50° C. to about 90° C., although the melting point can be outside of these ranges. The crystalline resin may have a number average molecular weight (Mn), as measured by gel permeation chromatography (GPC) of, for example, from about 1,000 to about 50,000, in embodiments from about 2,000 to about 25,000 (although the Mn can be outside of these ranges), and a weight average molecular weight (Mw) of, for example, from about 2,000 to about 100,000, in embodiments from about 3,000 to about 80,000 (although the Mw can be outside of these ranges), as determined by Gel Permeation Chromatography using polystyrene standards. The molecular weight distribution (Mw/Mn) of the crystalline resin may be, for example, from about 2 to about 6, in embodiments from about 3 to about 4, although the molecular weight distribution can be outside of these ranges.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin, although the amounts can be outside of these ranges.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin, although the amounts can be outside of these ranges.

Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin, although the amounts can be outside of these ranges.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

In embodiments, an unsaturated, amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof. In embodiments, the amorphous resin utilized in the core may be linear.

In embodiments, a suitable amorphous polyester resin may be a poly(propoxylated bisphenol A co-fumarate) resin having the following formula (I):

(I)

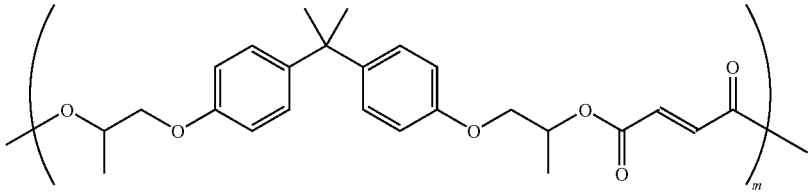

wherein m may be from about 5 to about 1000, although m can be outside of this range. Examples of such resins and processes for their production include those disclosed in U.S. Pat. No. 6,063,827, the disclosure of which is hereby incorporated by reference in its entirety.

An example of a linear propoxylated bisphenol A flumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM 181635 from Reichhold, Research Triangle Park, N.C. and the like.

In embodiments, a suitable amorphous resin utilized in a toner of the present disclosure may have a molecular weight of from about 10,000 to about 100,000, in embodiments from about 15,000 to about 30,000.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

(II)

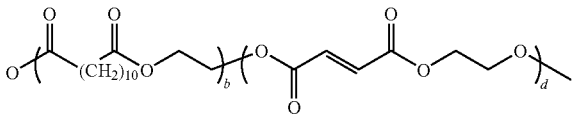

wherein b is from about 5 to about 2000 and d is from about 5 to about 2000, although the values of b and/or d can be outside of these ranges.

In embodiments, a suitable crystalline resin utilized in a toner of the present disclosure may have a molecular weight of from about 10,000 to about 100,000, in embodiments from about 15,000 to about 30,000.

One, two, or more resins may be used in forming a toner. In embodiments where two or more resins are used, the resins may be in any suitable ratio (e.g., weight ratio) such as, for instance, from about 1% (first resin)/99% (second resin) to about 99% (first resin)/1% (second resin), in embodiments from about 10% (first resin)/90% (second resin) to about 90% (first resin)/10% (second resin), although weight ratios outside these ranges may be utilized.

In embodiments, a suitable toner of the present disclosure may include 2 amorphous polyester resins and a crystalline polyester resin. The weight ratio of the three resins may be from about 29% first amorphous resin/69% second amorphous resin/2% crystalline resin, to about 60% first amorphous resin/20% second amorphous resin/20% crystalline resin, although the ratio can be outside of these ranges.

As noted above, in embodiments, the resin may be formed by emulsion aggregation methods. Utilizing such methods, the resin may be present in a resin emulsion, which may then be combined with other components and additives to form a toner of the present disclosure.

Toner

The resin of the resin emulsions described above, in embodiments a polyester resin, may be utilized to form toner compositions. Such toner compositions may include optional colorants, waxes, and other additives. Toners may be formed utilizing any method within the purview of those skilled in the art including, but not limited to, emulsion aggregation methods.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition, although the amounts can be outside of these ranges.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

UV Additives

In accordance with the present disclosure, the toners produced herein are invisible, i.e., prints made with the toner are not visible under normal viewing conditions. However, these toners may, in embodiments, become visible using light of a suitable wavelength, in embodiments ultraviolet (UV) light of a predetermined wavelength. This visibility may be imparted to the toner by the addition of an additive, referred to herein, in embodiments, as a UV additive, which may be a material that only becomes visible upon exposure to UV light.

Suitable materials which may be utilized as the UV additives include, for example, both organic and/or inorganic materials. Suitable inorganic materials include metal oxides such as titanium oxide, zinc oxide, aluminum oxide, and combinations thereof. Organic materials which may be utilized as UV additives include materials possessing benzophenone, also known as benzone groups, including (2-hydroxy-4-methoxyphenyl)-phenylmethanone (also referred to as oxybenzone, and sold under the trade names EUSOLEX® 4360, and ESCALOL® 567), 1-(4-methoxyphenyl)-3-(4-tert-butylphenyl)propane-1,3-dione (also referred to as avobenzone, and sold under the trade names PARSOL® 1789, EUSOLEX® 9020, ESCALOL® 517) and others, such as butyl methoxydibenzoylmethane, and combinations of the foregoing, all of which absorb light in the UV spectrum at a wavelength of from about 250 nm to about 400 nm. Other examples of suitable benzophenone UV light absorbing materials include commercially available series including, for example, LOWILITE® 20, LOWILITE® 205, LOWILITE® 24, and others, all available from Great Lake Chemical Corporation, IN, USA. Other suitable benzophenone NV light absorbing materials include those commercially available from CIBA, for example CHIMASSORB 81. Organic materials having benzone functional groups may be useful as light absorbing materials because of their chemical stability when compared with small organic molecules.

Another class of suitable materials which may be utilized as UV additives include benzotriazole UV absorbers. Examples include 2-(2'-hydroxy-3'-t-butyl-5'-methylphenyl-5-chloro)benzotriazole, sold as LOWILITE® 26, by Great Lakes. Other benzotriazole compounds include 2-(2'-hydroxy-3-sec-butyl-5-t-butylphenyl)benzotriazole (LOWILITE® 35) and 2-(2'-hydroxy-5'-methylphenyl)benzotriazole (LOWILITE® 55). Benzotriazole UV absorbing materials are also sold by Ciba under the trade name TINUVIN®. Examples include TINUVIN P, TINUVIN 234, TINUVIN 326, and others.

The UV additives may be nano-sized, i.e., they may be of a volume average diameter of less than about 300 nm, in embodiments from about 10 nm to about 300 nm, in other embodiments from about 50 nm to about 200 nm. The additives may be added to the other components of the toner composition described above utilizing any method within the purview of those skilled in the art including, but not limited to, for example, mixing, blending, combinations thereof, and the like.

The UV additive may be present in a toner of the present disclosure in an amount of from about 0.1% by weight of the toner to about 10% by weight of the toner, in embodiments from about 2% by weight of the toner to about 6% by weight of the toner.

The light absorption of a toner possessing a UV additive in accordance with the present disclosure can thus be tuned so that it appears upon exposure to UV light at a wavelength of from about 200 nm to about 400 nm, in embodiments from about 250 nm to about 310 nm, by using different classes of light absorbing materials. Optional security levels may be designed based upon the selection and use of differeing UV additives and their absorption of light at different wavelengths. For example, in embodiments, titanium oxide (also referred to herein, in embodiments, as titania), which absorbs short wavelength UV at from about 250 nm to about 320 nm, may be utilized as a UV additive for high security applications. In other embodiments, zinc oxide, which absorbs long wavelength UV at from about 250 nm to about 400 nm, may be used for low security prints.

Wax

Optionally, a wax may also be combined with the resin and UV additive in forming toner particles. When included, the wax may be present in an amount of, for example, from about 1 weight percent to about 25 weight percent of the toner particles, in embodiments from about 5 weight percent to about 20 weight percent of the toner particles, although the amounts can be outside of these ranges.

Waxes that may be selected include waxes having, for example, a weight average molecular weight of from about 500 to about 20,000, in embodiments from about 1,000 to about 10,000, although the weights can be outside of these ranges. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion-aggregation processes, such as a process that includes aggregating a mixture of an optional wax and any other desired or required additives, and emulsions including the resins described above, optionally in surfactants as described above, and then coalescing the aggregate mixture. A mixture may be prepared by adding an optional wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 4.5, although the pH can be outside of this range. Additionally, in embodiments, the mixture may be homogenized. If the mixture is homogenized, homogenization may be accomplished by mixing at about 600 to about 4,000 revolutions per minute, although the speed of mixing can be outside of this range. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture, although the amounts can be outside of these ranges. This provides a sufficient amount of agent for aggregation.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes, although more or less time may be used as desired or required. The addition of the agent may also be done while the mixture is maintained under stirred conditions, in embodiments from about 50 rpm to about 1,000 rpm, in other embodiments from about 100 rpm to about 500 rpm (although the mixing speed can be outside of these ranges), and at a temperature that is below the glass transition temperature of the resin as discussed above, in embodiments from about 30° C. to about 90° C., in embodiments from about 35° C. to about 70° C. (although the temperature can be outside of these ranges).

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C. (although the temperature can be outside of this range), and holding the mixture at this temperature for a time from about 0.5 hours to about 6 hours, in embodiments from about hour 1 to about 5 hours (although time periods outside of these ranges can be used), while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Shell Resin

In embodiments, an optional shell may be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described above. The aggregated particles described above may be combined with said emulsion so that the resin forms a shell over the formed aggregates. In embodiments, an amorphous polyester may be utilized to form a shell over the aggregates to form toner particles having a core-shell configuration.

Once the desired final size of the toner particles is achieved, the pH of the mixture may be adjusted with a base to a value of from about 6 to about 10, and in embodiments from about 6.2 to about 7, although a pH outside of these ranges can be used. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above. The base may be added in amounts from about 2 to about 25 percent by weight of the mixture, in embodiments from about 4 to about 10 percent by weight of the mixture, although amounts outside of these ranges can be used.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 75° C., in embodiments about 70° C. (although temperatures outside of these ranges can be used), which may be below the melting point of the crystalline resin to prevent plasticization. Higher or lower temperatures may be used, it being understood that the temperature is a function of the resins used for the binder.

Coalescence may proceed and be accomplished over a period of from about 0.1 to about 9 hours, in embodiments from about 0.5 to about 4 hours, although periods of time outside of these ranges can be used.

After coalescence, the mixture may be cooled to room temperature, such as from about 20° C. to about 25° C. (although temperatures outside of this range can be used). The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner, although amounts outside of these ranges can be used. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like. Such charge control agents may be applied simultaneously with the shell resin described above or after application of the shell resin.

There can also be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner, although amounts outside these ranges can be used. Suitable additives include those disclosed in U.S. Pat. Nos. 3,590,000, 3,800,588, and 6,214,507, the disclosures of each of which are hereby incorporated by reference in their entirety. Again, these additives may be applied simultaneously with a shell resin described above or after application of the shell resin.

In embodiments, toners of the present disclosure may be utilized as ultra low melt (ULM) toners. In embodiments, the dry toner particles, exclusive of external surface additives, may have the following characteristics:

(1) Volume average diameter (also referred to as "volume average particle diameter") of from about 3 to about 20 μm, in embodiments from about 4 to about 15 μm, in other embodiments from about 5 to about 9 μm, although a volume average diameter outside these ranges can be obtained.

(2) Number Average Geometric Standard Deviation (GSDn) and/or Volume Average Geometric Standard Deviation (GSDv) of from about 1.05 to about 1.55, in embodiments from about 1.1 to about 1.4, although a GSDv outside these ranges can be obtained.

(3) Circularity of from about 0.9 to about 1 (measured with, for example, a Sysmex FPIA 2100 analyzer), in embodiments form about 0.95 to about 0.985, in other embodiments from about 0.96 to about 0.98, although a circularity outside these ranges can be obtained.

(4) Glass transition temperature of from about 40° C. to about 65° C., in embodiments from about 55° C. to about 62° C., although a glass transition temperature outside these ranges can be obtained.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/M) of from about −3 μC/g to about −35 μC/g, and a final toner charging after surface additive blending of from −10 μC/g to about −45 μC/g, although values outside these ranges can be obtained.

Utilizing the UV additives described herein, one can adjust the gloss level of a toner of the present disclosure to match the gloss level of any substrate, for example a paper substrate, to which the toner is to be applied. Thus, for example, the gloss level of a toner of the present disclosure may be adjusted from matte to gloss on paper, having a gloss as measured by Gardner Gloss Units (ggu) of from about 15 ggu to about 70 ggu, in embodiments from about 20 ggu to about 60 ggu.

In some cases an ionic crosslinker may be added to the toner compositions to further adjust the desired gloss of the toner compositions. Such ionic crosslinkers include, for example, $Al^{3+}$ crosslinkers, including aluminum sulfate ($Al_2(SO_4)_3$), polyaluminum chloride, polyaluminum sulfosilicate, and combinations thereof. The degree of ionic crosslinking may be influenced by the amount of retained metal ion, such as $Al^{3+}$, in the particle. The amount of retained metal ion may be further adjusted by the addition of EDTA in the formulation as described above. In embodiments, the amount of retained crosslinker, for example $Al^{3+}$, in toner particles of the present disclosure may be from about 50 ppm to about 1000 ppm, in other embodiments from about 500 ppm to about 800 ppm.

The resulting toners may be, in embodiments, a clear toner having a low and tunable gloss level, which contains light absorbing materials in the UV range. Utilizing the materials and methods of the present disclosure, one can produce invisible prints by matching the gloss level ot the toner with the substrate to which the toner is to be applied. The toner produces an invisible electrophotographic image (without differential gloss) under normal day-time viewing light, i.e., visible light, but appears darker under UV illumination. Prints made with toners of the present disclosure on white paper substrates (optionally containing optical brightners) may thus appear invisible under normal viewing light and become visible only when exposed to a predetermined UV light source. In embodiments, prints made with toners of the present disclosure may appear as darker areas over bright blue areas, due to absorption of the incident UV light by the light absorbing materials.

Thus, in embodiments, an electrophotographic image produced with a toner of the present disclosure may be invisible and have substantially no differential gloss between the toner and paper to which it is applied when exposed to light having a wavelength of from about 380 nm to about 750 nm, but the toner becomes visible when exposed to UV light as described above. In embodiments, images produced with toners of the present disclosure become visible when exposed to wavelengths of from about 200 nm to about 310 nm, in embodiments from about 220 nm to about 290 nm. As used herein, "no differential gloss" may mean that the difference in gloss units between the paper and the toner may be less than about 15 ggu, in embodiments less than about 10 ggu, in other embodiments less than about 5 ggu. "No differential gloss" may also mean that the difference in gloss units between the paper and the toner may be from about 0.01 ggu to about 15 ggu, in embodiments from about 0.1 ggu to about 10 ggu, in other embodiments from about 1 ggu to about 5 ggu.

One advantage of these invisible watermarks, which differs from the use of inkjet printers, includes the simplified design of the electrophotographic machine and the ability to apply the toners of the present disclosure with such an electrophotographic machine.

Developers

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer, although amounts outside these ranges can be used.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %, although amounts outside these ranges can be used. The coating may have a coating weight of, for example, from about 0.1 to about 5% by weight of the carrier, in embodiments from about 0.5 to about 2% by weight of the carrier, although amounts outside these ranges can be used.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles (although amounts outside these ranges can be used), until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size (although sizes outside these ranges can be used), coated with about 0.5% to about 10% by weight, in embodiments from about 0.7% to about 5% by weight (although amounts outside these ranges can be used) of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition (although amounts outside these ranges can be used). However, different toner and carrier percentages may be used to achieve a developer composition with desired characteristics.

Imaging

The toners can be utilized for electrostatographic or electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C. (although temperatures outside these ranges can be used), after or during melting onto the image receiving substrate.

In embodiments where the toner resin is crosslinkable, such crosslinking may be accomplished in any suitable manner. For example, the toner resin may be crosslinked during fusing of the toner to the substrate where the toner resin is crosslinkable at the fusing temperature. Crosslinking also may be effected by heating the fused image to a temperature at which the toner resin will be crosslinked, for example in a post-fusing operation. In embodiments, crosslinking may be effected at temperatures of from about 160° C. or less, in embodiments from about 70° C. to about 160° C., in other embodiments from about 80° C. to about 140° C., although temperatures outside these ranges can be used.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

For some of the toners of the examples, UV additive dispersions were prepared. For each UV additive dispersion, about 20 grams of $TiO_2$ or ZnO were separately added to about 72.79 grams of deionized water with about 7.21 grams of DOWFAX™ 2A1 and agitated for about 10 minutes. The solutions were homogenized for about 10 minutes to achieve a narrowly distributed pigment solution. The solids content of the resulting $TiO_2$ dispersion was about 17.17%, and the solids content of the resulting ZnO dispersion was about 21.28%. The examples also used various amorphous and crystalline polyesters, optionally in an emulsion, the preparation of which is described below.

Amorphous Polyester Emulsion A preparation. About 260 grams of a poly(propoxylated bisphenol A-co-fumarate) resin having a Tg onset of about 60° C. and a molecular weight of about 20,000 was combined with about 1100 grams of ethyl acetate at approximately 65° C. to form a first solution. An aqueous solution of about 1.9 grams of DOWFAX™ 2A1 (an alkyldiphenyloxide disulfonate surfactant from Dow Chemical) and about 3 grams of concentrated ammonium hydroxide were dissolved in about 850.7 grams of deionized water at about 70° C. The first solution was combined with the aqueous solution under continuous high-shear homogenization using an IKA Ultra-Turrax T50 set to about 10,000 rpm. After about 30 minutes of homogenization, the reaction mixture was distilled at about 80° C. for about two hours. The resulting emulsion was cooled and collected and an average particle size of about 207 nm.

Amorphous Polyester Emulsion B preparation. About 260 grams of a poly(propoxylated Bisphenol A-co-fumarate) resin having a Tg onset about 56° C. and a molecular weight of about 50,000 was combined with about 1100 grams of ethyl acetate at approximately 65° C. to form a first solution. An aqueous solution of about 1.9 grams of DOWFAX™ 2A1 (an alkyldiphenyloxide disulfonate surfactant from Dow Chemical) and about 3 grams of concentrated ammonium hydroxide were dissolved in about 850.7 grams of deionized water at about 70° C. The first solution was combined with the aqueous solution under continuous high-shear homogenization using an IKA Ultra-Turrax T50 set to about 10,000 rpm. After about 30 minutes of homogenization, the reaction mixture was distilled at about 80° C. for about two hours. The resulting emulsion was cooled and collected and an average particle size of about 215 nm.

Crystalline Polyester Emulsion C preparation. About 260 grams of a poly nonanediol-co-dodecanedioic acid) resin having a melting point of about 70° C. and a molecular weight of about 20,000 was combined with about 1100 grams of ethyl acetate at approximately 65° C. to form a first solution. An aqueous solution of about 1.9 grams of DOWFAX™ 2A1 (an alkyldiphenyloxide disulfonate surfactant from Dow Chemical) and about 3 grams of concentrated ammonium hydroxide were dissolved in about 850.7 grams of deionized water at about 70° C. The first solution was combined with the aqueous solution under continuous high-shear homogenization using an IKA Ultra-Turrax T50 set to about 10,000 rpm. After about 30 minutes of homogenization, the reaction mixture was distilled at about 80° C. for about two hours. The resulting emulsion was cooled and collected and an average particle size of about 151 nm.

Example 1

Matte Clear Toner

About 70.87 grams of Amorphous Polyester Emulsion A (having a particle size of about 207 nm; about 39.16 wt %), about 77.93 grams of Amorphous Polyester Emulsion B (having a particle size of about 215 nm; about 35.61 wt %), about 23.79 grams of Crystalline Polyester Emulsion C (having a particle size of about 151 nm; about 31.14 wt %), about 2.7 grams DOWFAX™ 2A1 and about 31.11 grams wax emulsion (polyethylene wax), were added to about 369.19 grams of deionized water in a glass kettle and homogenized using an IKA Ultra Turrax T50 homogenizer operating at about 4000 revolutions per minute (rpm).

Thereafter, about 1.79 grams of $Al_2(SO_4)_3$ mixed with about 48 grams of deionized water as a flocculent was added drop-wise to the kettle and homogenized for about 10 minutes. The mixture was degassed for about 20 minutes with mixing at about 280 rpm and then heated at about 1° C. per minute to a temperature of about 37° C. with mixing at about 460 rpm for aggregation. The particle size was monitored using a Coulter Counter until the particle size reached about 5 μm.

To form a shell, a shell mixture including about 35.75 grams of Amorphous Polyester Emulsion A, about 39.02 grams of Amorphous Polyester Emulsion B, about 1.2 grams of DOWFAX™ 2A1, and about 37 grams of deionized water, was immediately introduced into the reaction and allowed to aggregate for from about 10 to about 20 minutes at about 40° C., with mixing at about 460 rpm. Once the volume average particle diameter was above about 5.7 μm (according to the measurement with a Coulter Counter), the pH of the aggregation slurry was slowly adjusted to about 8.6 and maintained by the addition of about 4 wt % of NaOH solution with mixing at about 180 rpm to freeze the toner aggregation until the temperature reached about 85° C. After freezing, the toner slurry was heated to coalesce. The resulting toner had a final particle size of about 6.02 μm, GSD v/n about 1.21/1.226, and circularity of about 0.967. The toner slurry was then cooled to room temperature, separated by sieving (25 μm) and filtered, then washed and freeze dried.

Example 2

Clear Toner, 1.5 wt % $TiO_2$

About 69 grams of Amorphous Polyester Emulsion A, about 77 grams of Amorphous Polyester Emulsion B, about 23 grams of Crystalline Polyester Emulsion C, about 2.6 grams DOWFAX™ 2A1, about 9.5 grams $TiO_2$ (about 17.17 wt %), and about 31.11 grams wax emulsion (polyethylene wax), were added to about 363 grams of deionized water in a glass kettle and homogenized using an IKA Ultra Turrax T50 homogenizer operating at about 4000 rpm.

Thereafter, about 1.79 grams of $Al_2(SO_4)_3$ mixed with about 48 grams of deionized water as a flocculent was added drop-wise to the kettle and homogenized for about 10 minutes. The mixture was degassed for about 20 minutes with mixing at about 280 rpm and then heated at about 1° C. per minute to a temperature of about 37° C. with mixing at about 460 rpm for aggregation. The particle size was monitored using a Coulter Counter until the particle size reached about 5 μm.

To form a shell, a shell mixture including about 35.75 grams of Amorphous Polyester Emulsion A, about 39.02 grams of Amorphous Polyester Emulsion B, about 1.2 grams of DOWFAX™ 2A1, and about 37 grams of deionized water, was immediately introduced into the reaction and allowed to aggregate for from about 10 to about 20 minutes at about 40° C., and mixing at about 460 rpm. Once the volume average particle diameter was above about 5.7 μm (according to the measurement with a Coulter Counter), the pH of the aggregation slurry was adjusted to about 4 by the addition of about 4 wt % of NaOH solution, followed by the addition of about 3.8 grams EDTA and thereafter decreased the speed of mixing to about 190 rpm to freeze the toner aggregation. After freezing, the toner slurry was heated to coalesce. The resulting toner had a final particle size of about 5.77 μm, GSD v/n about 1.18/1.22, and circularity of about 0.964. The toner slurry was then cooled to room temperature, separated by sieving (25 μm) and filtered, then washed and freeze dried.

Example 3

Clear Toner

About 70.87 grams of Amorphous Polyester Emulsion A, about 77.93 grams of Amorphous Polyester Emulsion B, about 23.79 grams of Amorphous Polyester Emulsion C, about 2.7 grams DOWFAX™ 2A1, and about 31.11 grams wax emulsion (polyethylene wax), were added to about 369.194 grams of deionized water in a glass kettle and homogenized using an IKA Ultra Turrax T50 homogenizer operating at about 4000 rpm.

Thereafter, about 1.79 grams of $Al_2(SO_4)_3$ mixed with about 48 grams of deionized water as a flocculent was added drop-wise to the kettle and homogenized for about 10 minutes. The mixture was degassed for about 20 minutes with mixing at about 280 rpm and then heated at about 1° C. per minute to a temperature of about 37° C. with mixing at about 460 rpm for aggregation. The particle size was monitored using a Coulter Counter until the particle size reached about 5 μm.

To form a shell, a shell mixture including about 35.75 grams of Amorphous Polyester Emulsion A, about 39.02 grams of Amorphous Polyester Emulsion B, about 1.2 grams of DOWFAX™ 2A1, and about 37 grams of deionized water, was immediately introduced into the reaction and allowed to aggregate for from about 10 to about 20 minutes at about 40° C., with mixing at about 460 rpm. Once the volume average particle diameter was above about 5.7 μm (according to the measurement with a Coulter Counter), the pH of the aggregation slurry was adjusted to about 4 by the addition of about 4 wt % of NaOH solution, followed by the addition of about 3.8 grams EDTA, and thereafter decreased the speed of mixing to about 190 rpm to freeze the toner aggregation. After freezing, the toner slurry was heated to coalesce. The resulting toner had a final particle size of about 5.77 μm, GSD v/n about 1.176/1.22, and circularity of about 0.97. The toner slurry was then cooled to room temperature, separated by sieving (25 μm) and filtered, then washed and freeze dried.

Comparative Example 1

Cyan Toner

About 70.87 grams of Amorphous Polyester Emulsion A, about 77.93 grams of Amorphous Polyester Emulsion B, about 23.79 grams of Amorphous Polyester Emulsion C, about 2.7 grams DOWFAX™ 2A1, about 35 grams cyan pigment aqueous dispersion (17 weight % Pigment Blue 15:3), and about 31.11 grams of a wax emulsion (polyethylene wax), were added to about 369.194 grams of deionized water in a glass kettle and homogenized using an IKA Ultra Turrax T50 homogenizer operating at about 4000 rpm.

Thereafter, about 1.79 grams of $Al_2(SO_4)_3$ mixed with about 48 grams of deionized water as a flocculent, was added drop-wise to the kettle and homogenized for about 10 minutes. The mixture was degassed for about 20 minutes with mixing at about 280 rpm and then heated at about 1° C. per minute to a temperature of about 37° C. with mixing at about 460 rpm for aggregation. The particle size was monitored using a Coulter Counter until the particle size reached about 5 μm.

To form a shell, a shell mixture including about 35.75 grams of Amorphous Polyester Emulsion A, about 39.02 grams of Amorphous Polyester Emulsion B, about 1.2 grams of DOWFAX™ 2A1, and about 37 grams of deionized water, was immediately introduced into the reaction and allowed to aggregate for from about 10 minutes to about 20 minutes at about 40° C., with mixing at about 460 rpm. Once the volume average particle diameter was above about 5.7 μm (according to the measurement with a Coulter Counter), the pH of the aggregation slurry was adjusted to about 4 by the addition of about 4 wt % of NaOH solution, followed by the addition of about 3.8 grams EDTA, and thereafter decreased the speed of mixing to about 190 rpm to freeze the toner aggregation. After freezing, the toner slurry was heated to coalesce. The resulting toner had a final particle size of about 5.77 μm, a GSD v/n about 1.19/1.28, and a circularity of about 0.961. The toner slurry was then cooled to room temperature, separated by sieving (25 μm) and filtered, then washed and freeze dried.

A summary of some of the components and properties of the toners of Examples 1-3 is provided in Table 1 below:

TABLE 1

| | $TiO_2$ | EDTA pph | Al ppm | GSD v | Circularity |
|---|---|---|---|---|---|
| Example 1 | 0 | 0 | 712 | 1.21 | 0.967 |
| Example 2 | 1.5 | 1.5 | 65 | 1.18 | 0.964 |
| Example 3 | 0 | 1.5 | 62 | 1.18 | 0.970 |
| Comparative Example 1 | 0 | 1.5 | 59 | 1.19 | 0.961 |

Printing Tests

Samples of each of the above Examples 1-3 were fused to determine the initial fusing performance of the $TiO_2$ containing toners (Example 2). Toner particles were combined with about 1.71 weight % polydimethylsiloxane treated silica of 40 nm particle size available from Evonik Degussa, about 0.88 weight % decyltrimethoxy silane treated titania of 15 nm×40 nm particle size available from Tayca, about 1.73 weight % 150 nm sol-gel silica surface treated with hexamethyldisilazane, available from Shin-Etsu Chemical Co., Ltd., about 0.55 weight % 500-600 nm particle size cerium oxide available from Mitsui Mining, and about 0.2 weight % zinc stearate, and blended in a sample mill at 15,000 RPM for 30 seconds. An oil-less color fuser in a DC250 printer, commercially available from Xerox, was used as the test fixture. Unfused images were generated using a DCI2 at about 0.5 $mg/cm^2$ and 1 $mg/cm^2$ toner mass per unit area onto an uncoated paper, Color Xpressions+ (90 gsm), as well as coated paper, Digital Color Elite gloss (120 gsm) (both commercially available from Xerox Corporation), before being run through the fuser. Process speed of the fuser was set to about 220 mm/second and the fuser roll temperature was varied from gloss offset to where hot offset occurred. The print gloss of the fused prints was then measured using a BYK Gardner 75° gloss meter. A summary of the gloss results for the above Examples and Comparative Example is shown in the FIGURE, which shows the gloss on CX+ paper as a function of fusing temperature.

As shown in FIG. 1, the gloss curves of Examples 3, 1 and 2 indicate the flexibility to move the gloss level of a toner between about 15 ggu and about 65 ggu. Clear glossy toner had the same gloss level as a clear toner having about 1.5 wt % $TiO_2$. The gloss of the CX+ paper was about 10 ggu.

Electrophotographic images of the toners of Examples 1, 2 and 3 were then obtained under both visible light and the UV spectrum. It was found that the toner of Example 1 (matte clear toner) on CX+ paper was invisible under visible light as the gloss matched the paper gloss, from about 10 ggu to about 15 ggu. The formulation also worked if combined with titania or zinc oxide. The toners of Examples 2 and 3, which used a glossy toner that had a differential gloss with the substrate CX+, had images that were clearly visible under visible light and were not suitable for security printing on the CX+ paper (having a gloss of about 10 ggu). However, these toners would be suitable for security printing on a more glossy substrate where the gloss of the toner and the paper matched in gloss. It was also found that the toner of Example 1 (Matte toner) on CX+ paper was readable under the UV spectrum, as was the toner of Example 2 (having about 1.5 wt % $TiO_2$). Inorganic absorbents generated strong absorption and did not attenuate with time.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaged substrate comprising a toner applied in an imagewise pattern to a substrate, wherein the toner comprises:

at least one amorphous polyester resin;

at least one crystalline polyester resin;

at least one additive capable of becoming visible upon exposure to ultraviolet light at a wavelength of from about 200 nm to about 400 nm when placed on a substrate containing fluorescent materials; and optionally, one or more ingredients selected from the group consisting of waxes, coagulants, and combinations thereof, wherein the gloss of the toner substantially matches the gloss of the substrate to which it is applied, wherein the imagewise pattern of toner on the substrate is substantially invisible when viewed under natural light.

2. A substrate according to claim 1, wherein the at least one amorphous resin is selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

3. A substrate according to claim 1, wherein the at least one amorphous resin comprises a poly(propoxylated bisphenol A co-fumarate) resin of the formula:

(I)

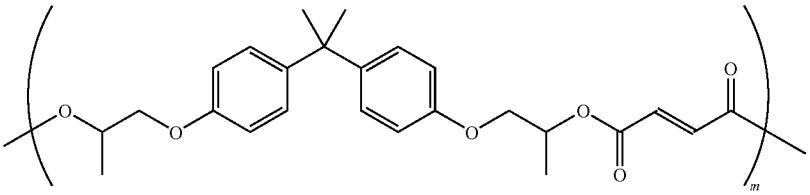

wherein m is from about 5 to about 1000.

4. A substrate according to claim 1, wherein the at least one crystalline resin is selected from the group consisting of poly-ethylene-adipate), poly(propylene-adipate), poly(butylene-adipate), poly(pentylene-adipate), poly(hexylene-adipate), poly(octylene-adipate), poly(ethylene-succinate), polypropylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly(ethylene -sebacate), copoly(ethylene-fumarate)-copoly(ethylene-decanoate), copoly(ethylene-fumarate)-copoly(ethylene-dodecanoate), and combinations thereof.

5. A substrate according to claim 1, wherein the at least one additive capable of becoming visible upon exposure to ultraviolet light when placed on a substrate containing fluorescent materials comprises an inorganic material selected from the group consisting of titanium oxide, zinc oxide, aluminum oxide, and combinations thereof, having a particle size of from about 10 nm to about 300 nm.

6. A substrate according to claim 1, wherein the at least one additive capable of becoming visible upon exposure to ultraviolet light comprises an organic material selected from the group consisting of benzophenones, benzothiazoles and combinations thereof.

7. A substrate according to claim 1, wherein the at least one additive capable of becoming visible upon exposure to ultraviolet light is present in an amount of from about 0.1% by weight of the toner to about 10% by weight of the toner.

8. A substrate according to claim 1, further comprising an ionic crosslinker, wherein the ionic crosslinker and the at least one additive capable of becoming visible upon exposure to ultraviolet light is selected so that the toner possesses a gloss matching a gloss of a substrate to which the toner is to be applied.

9. A process comprising:

determining a gloss of a substrate;

contacting at least one amorphous polyester resin, and at least one crystalline polyester resin in an emulsion;

contacting the emulsion with at least one additive capable of becoming visible upon exposure to ultraviolet light at a wavelength of from about 200 nm to about 400 nm;

contacting the emulsion with at least one ionic crosslinker;

contacting the emulsion with an optional wax, and an optional coagulant to form a mixture;

aggregating small particles in the mixture to form a plurality of larger aggregates;

coalescing the larger aggregates to form toner particles; and recovering the toner particles, wherein the toner particles possess a gloss that equals the gloss of the substrate;

wherein the toner is substantially invisible when viewed under natural light.

10. A process according to claim 9, wherein the at least one amorphous polyester resin is selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof, and the at least one crystalline polyester resin is selected from the group consisting of poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof.

11. A process according to claim 9, wherein the at least one additive capable of becoming visible upon exposure to ultraviolet light comprises an inorganic material selected from the group consisting of titanium oxide, zinc oxide, aluminum oxide, and combinations thereof, having a particle size of from about 10 nm to about 300 nm.

12. A process according to claim 9, wherein the at least one additive capable of becoming visible upon exposure to ultraviolet light comprises an organic material selected from the group consisting of benzophenones, benzothiazoles, and combinations thereof.

13. A process according to claim 9, wherein the ionic crosslinker is selected from the group consisting of aluminum sulfate, polyaluminum chloride, polyaluminum sulfosilicate, and combinations thereof, the chelating agent comprises ethylene diamine tetraacetic acid, and wherein the gloss of the toner and the gloss of the substrate is from about 15 ggu to about 70 ggu.

14. A substrate according to claim 1 wherein the toner is an emulsion aggregation toner.

15. A substrate according to claim 1 wherein the additive is blended with the amorphous resin and the crystalline resin in the toner.

16. A substrate according to claim 1 wherein the substrate is paper.

17. A substrate according to claim 1 wherein the toner contains a wax in an amount of from about 1 to about 25 percent by weight.

18. A process which comprises:

(a) providing a substrate with a pre-determined gloss level;

(b) applying a toner image to the substrate, wherein the toner is an emulsion aggregation toner which comprises:

(i) at least one amorphous polyester resin;

(ii) at least one crystalline polyester resin;

(iii) at least one additive capable of becoming visible upon exposure to ultraviolet light at a wavelength of from about 200 nm to about 400 nm when placed on a substrate containing fluorescent materials; and (iv) a wax; and (c) fusing the toner image to the substrate;

wherein the gloss of the toner substantially matches the gloss of the substrate to which it is applied;

wherein the toner image on the substrate is substantially invisible when viewed under natural light.

* * * * *